US011143451B2

(12) United States Patent
Caglin et al.

(10) Patent No.: US 11,143,451 B2
(45) Date of Patent: Oct. 12, 2021

(54) HOUSEHOLD APPLIANCE HAVING A PART BEING RELEASABLY ATTACHED

(71) Applicant: BSH HAUSGERAETE GMBH, Munich (DE)

(72) Inventors: Muharrem Uemit Caglin, Istanbul (TR); Ercan Ilman, Istanbul (TR); Oezguer Uysal, Istanbul (TR)

(73) Assignee: BSH Hausgeraete GmbH, Munich (DE)

( * ) Notice: Subject to any disclaimer, the term of this patent is extended or adjusted under 35 U.S.C. 154(b) by 44 days.

(21) Appl. No.: 16/571,693

(22) Filed: Sep. 16, 2019

(65) Prior Publication Data

US 2020/0116419 A1 Apr. 16, 2020

(30) Foreign Application Priority Data

Oct. 12, 2018 (TR) ..... 2018/15130

(51) Int. Cl.
*F25D 23/02* (2006.01)
*E05F 5/02* (2006.01)

(52) U.S. Cl.
CPC ..... *F25D 23/028* (2013.01); *E05F 5/02* (2013.01); *E05Y 2900/31* (2013.01)

(58) Field of Classification Search
CPC ..... F25D 23/028; F25D 23/065; E05F 5/02; E05F 5/10; E05Y 2900/31; E05Y 2600/53; E05Y 2800/242; E05D 5/0223; E05D 5/0238; E05D 5/0276; E05D 5/14; E05D 2005/145
See application file for complete search history.

(56) References Cited

U.S. PATENT DOCUMENTS 4,999,873 A * 3/1991 Lisak ..... A47L 15/4261 16/82
5,061,112 A * 10/1991 Monford, Jr. ..... F16B 21/165 403/328
6,553,617 B1 * 4/2003 Salice ..... E05F 5/02 16/82
8,047,343 B1 * 11/2011 Chen ..... F16F 9/22 188/322.19
8,052,233 B2 * 11/2011 Netzer ..... A47B 88/467 312/330.1
9,223,355 B2 * 12/2015 Kim ..... G06F 1/1679
9,464,376 B2 * 10/2016 Kim ..... D06F 39/14
10,260,267 B2 * 4/2019 Kirenci ..... E05F 3/06
(Continued)

FOREIGN PATENT DOCUMENTS

DE 9210092 U1 * 9/1992 ..... E05F 5/006
DE 102015013422 A1 * 4/2017 ..... F16F 9/49
(Continued)

*Primary Examiner* — Hanh V Tran
(74) *Attorney, Agent, or Firm* — Laurence A. Greenberg; Werner H. Sterner; Ralph E. Locher

(57) ABSTRACT

A household appliance contains a part that is releasably attached onto to the household appliance through a snap-fit connection. The part is provided with two or more engagement sites including a first engagement site and a second engagement site distributed around an axis along a direction to be followed at a process for releasably securing of the part. Each of the first engagement site and the second engagement site has a different respective orthogonal projection on the axis.

12 Claims, 11 Drawing Sheets

(56) References Cited

U.S. PATENT DOCUMENTS 10,689,894 B2 * 6/2020 Diez Herrera ..... E05F 5/022
2004/0211717 A1 * 10/2004 Mitchell ..... B01D 35/153 210/235
2004/0211931 A1 * 10/2004 Olson ..... B01D 35/147 251/149.9
2006/0077653 A1 4/2006 Nowak et al.
2013/0134854 A1 * 5/2013 You ..... F25D 23/028 312/405
2013/0145580 A1 * 6/2013 Brunnmayr ..... E05F 5/006 16/277
2014/0115828 A1 * 5/2014 Cheng ..... E05F 5/02 16/375
2014/0345081 A1 * 11/2014 Salice ..... E05F 3/20 16/50
2014/0366322 A1 * 12/2014 Salice ..... E05F 5/006 16/277
2016/0086747 A1 * 3/2016 Goodwin ..... F25D 23/065 200/52 R
2016/0116206 A1 * 4/2016 Kempfle ..... F25D 23/028 312/405
2016/0245579 A1 * 8/2016 Eom ..... F25D 23/028
2016/0273777 A1 * 9/2016 Kim ..... E05F 5/02
2016/0314910 A1 * 10/2016 Buczkowski ..... H01H 3/08
2016/0377339 A1 * 12/2016 Kempfle ..... F25D 23/068 312/406
2017/0114855 A1 * 4/2017 Mihara ..... A47K 13/12
2017/0314633 A1 * 11/2017 Mihara ..... E05F 5/00
2017/0321953 A1 * 11/2017 Kempfle ..... F25D 23/028
2018/0073291 A1 * 3/2018 Vanini ..... E05F 5/00
2018/0080160 A1 * 3/2018 Mora ..... D06F 37/18
2018/0149412 A1 * 5/2018 Cakirca ..... F25D 29/005
2018/0149414 A1 * 5/2018 Cakirca ..... F25D 23/067
2018/0187470 A1 * 7/2018 Song ..... F25D 11/02
2018/0347892 A1 * 12/2018 Kim ..... F25D 23/028
2019/0338999 A1 * 11/2019 Lee ..... F25D 23/025
2020/0115945 A1 * 4/2020 Akca ..... F16F 9/285

FOREIGN PATENT DOCUMENTS

EP 3636866 A1 * 4/2020 ..... F25D 23/028
EP 3650728 A1 * 5/2020 ..... F16F 9/285
JP 06272447 A * 9/1994

* cited by examiner

HOUSEHOLD APPLIANCE HAVING A PART BEING RELEASABLY ATTACHED

CROSS-REFERENCE TO RELATED APPLICATION

This application claims the priority, under 35 U.S.C. § 119, of Turkish patent application TR 2018/15130, filed Oct. 12, 2018; the prior application is herewith incorporated by reference in its entirety.

BACKGROUND OF THE INVENTION

Field of the Invention

The present invention relates to a household appliance, in particular to a household appliance that includes snap-fit connection.

Snap-fit connections are a widely employed means for assembling household appliances.

Some of the household appliances that include snap-fit connections are cooling appliances such as refrigerators.

A household appliance provided with a means for snap-fit connection is described in the U.S. patent publication No. 2006/0077653 A1. It discloses a light assembly for a refrigerator drawer which includes a light source assembly, a reflector and a lens assembly keyed one to another for positioning, and secured to each other as a preassembled unit. The preassembled light assembly is snap fit into an opening in a panel of the drawer.

The invention provides an additional improvement, an additional advantage or an alternative to the prior art.

The purpose of the invention is to provide a household appliance with a balanced and reliable snap-fit connection with prolonged service life, and which is easy to assemble and disassemble.

BRIEF SUMMARY OF THE INVENTION

The invention is a household appliance containing a part which is releasably attached onto the household appliance through snap-fit connection. The part is provided with two or more engagement sites including a first engagement site and a second engagement site distributed around an axis along a direction to be followed at a process for releasably securing of the part.

Each of the first engagement site and second engagement site has a different respective orthogonal projection on the axis. This set of features provides a smooth and balanced operation in assembling and disassembling by linearly moving the part along the axis.

The orthogonal projections can be radially distributed on the axis. This provides an enhanced support along the axis by a balanced pressure distribution onto the part along the axis at releasable attaching of the part, thereby prolonging the service life.

The part can include a male snap-fit connector provided with the first engagement site and second engagement site. Here, the male snap-fit connector can be adapted to engage with a female snap-fit connector which is provided with respective counterparts including a first counterpart and a second counterpart; the first and second counterparts being adapted by their shape and size to respectively threshold the first engagement site and the second engagement site at the releasably securing.

The male snap-fit connector can be attached to the part at a first end thereof, such that another end of the male snap-fit connector distal to the first end remains as a free-end, thereby providing an enhanced flexibility to the male snap-fit connector.

A portion of the male snap-fit connector between two adjacent engagement sites can be provided with undulations. For instance, a portion of the male snap-fit connector between the first engagement site and the second engagement site can be undulated.

This feature enhances the flexibility of the male snap-fit connector and thereby facilitates the releasable securing process.

One or more of the first counterpart and second counterpart can have a first side surface adapted to be pushed by a respective engagement site at a securing phase of a releasably securing process of the part, and a second side surface adapted to be pushed by the respective engagement site at a releasing phase of the releasably securing process; such that a first angle between the first side surface and a line orthogonal to the axis is wider than a second angle between the second side surface and the line. This feature enables that a securing step at assembling of the household appliance is easier than a releasing step at partial disassembling of the household appliance.

The female snap-fit connector can be adapted to at least partly receive the part. The part can further include one or more housings for at least partly receiving and guiding one or more respective damping units. Thus a damper assembly is at least partly formed.

In this context, the part can include two or more housings for at least partly receiving and guiding two or more respective damping units; and the axis is located between two of the (e.g. adjacent) housings.

The damper assembly can be adapted to dampen a door of the household appliance at closing of the door. Thus, a household appliance with a soft door closing mechanism, which is easy to assemble and disassemble, may be obtained.

The household appliance can be a cooling appliance, e.g. a refrigerator.

Other features which are considered as characteristic for the invention are set forth in the appended claims.

Although the invention is illustrated and described herein as embodied in a household appliance having a part being releasably attached, it is nevertheless, not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
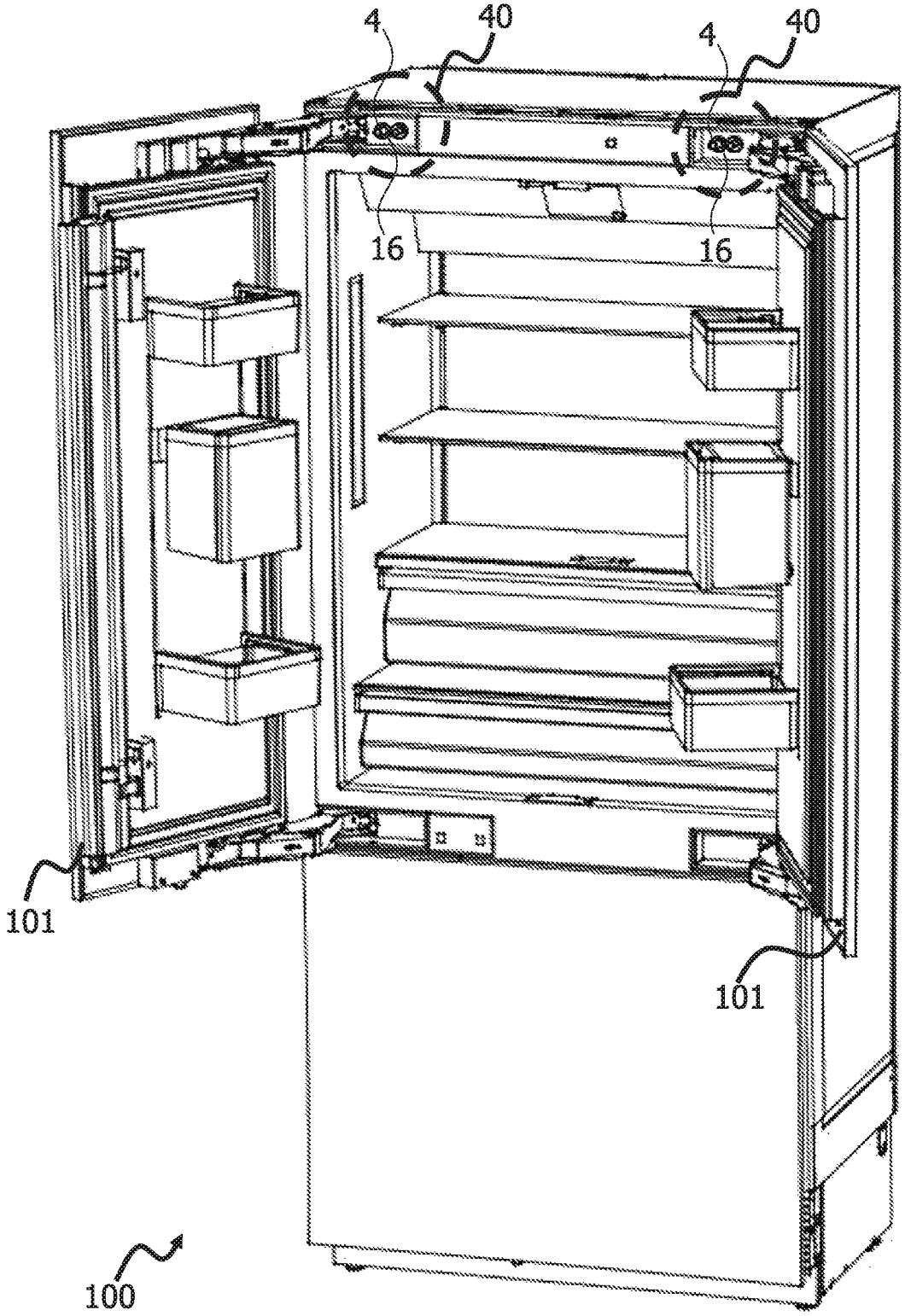
FIG. 1 is a perspective view of a household appliance according to the present invention, provided with damper assemblies mounted using a part as described in the following detailed description.

Referring now to the figures of the drawings in detail and first, particularly to FIG. 1 thereof, there is shown a household appliance 100, e.g. a cooling appliance. FIG. 1 shows a cooling appliance as an example to the household appliance 100 according to the present invention.

Figure 2:
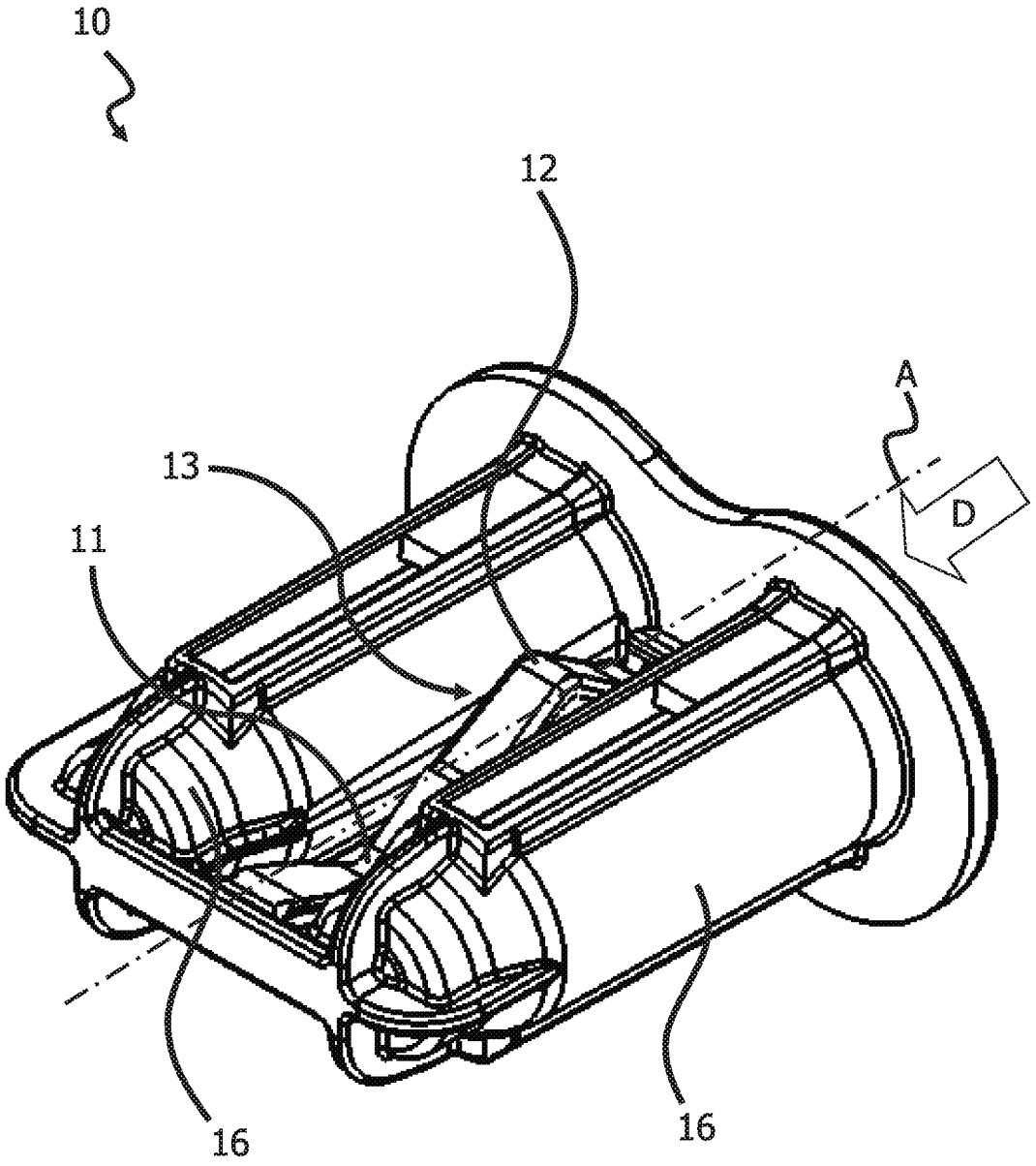
FIG. 2 is a perspective view of an exemplary part to be employed in the household appliance according to the present invention.

The gist of the present application relies on a part 10 which provides an easy assembly and disassembly, see FIG. 2. The exemplary household appliance 100 includes the part 10 for releasable attachment of a first item thereonto. For easy introduction of the invention, the first item is hereby exemplified over a housing 16 for partly receiving a damper 4. The exemplary household appliance 100 depicted in FIG. 1 includes a damper assembly 40 as an example to such first item, including a damper 40 for dampening the closing of a door 101 of the household appliance 100.

The part 10 is releasably attached onto the household appliance 100 through a snap-fit connection. The part 10 is provided with two or more engagement sites including a first engagement site 11 and a second engagement site 12. The presence of such a plurality of engagement sites provides a robust snap-fit connection, even when one of the first engagement site 11 or second engagement site 12 completes its service life or does not completely fits due to dimensional inconsistencies.

Figure 3:
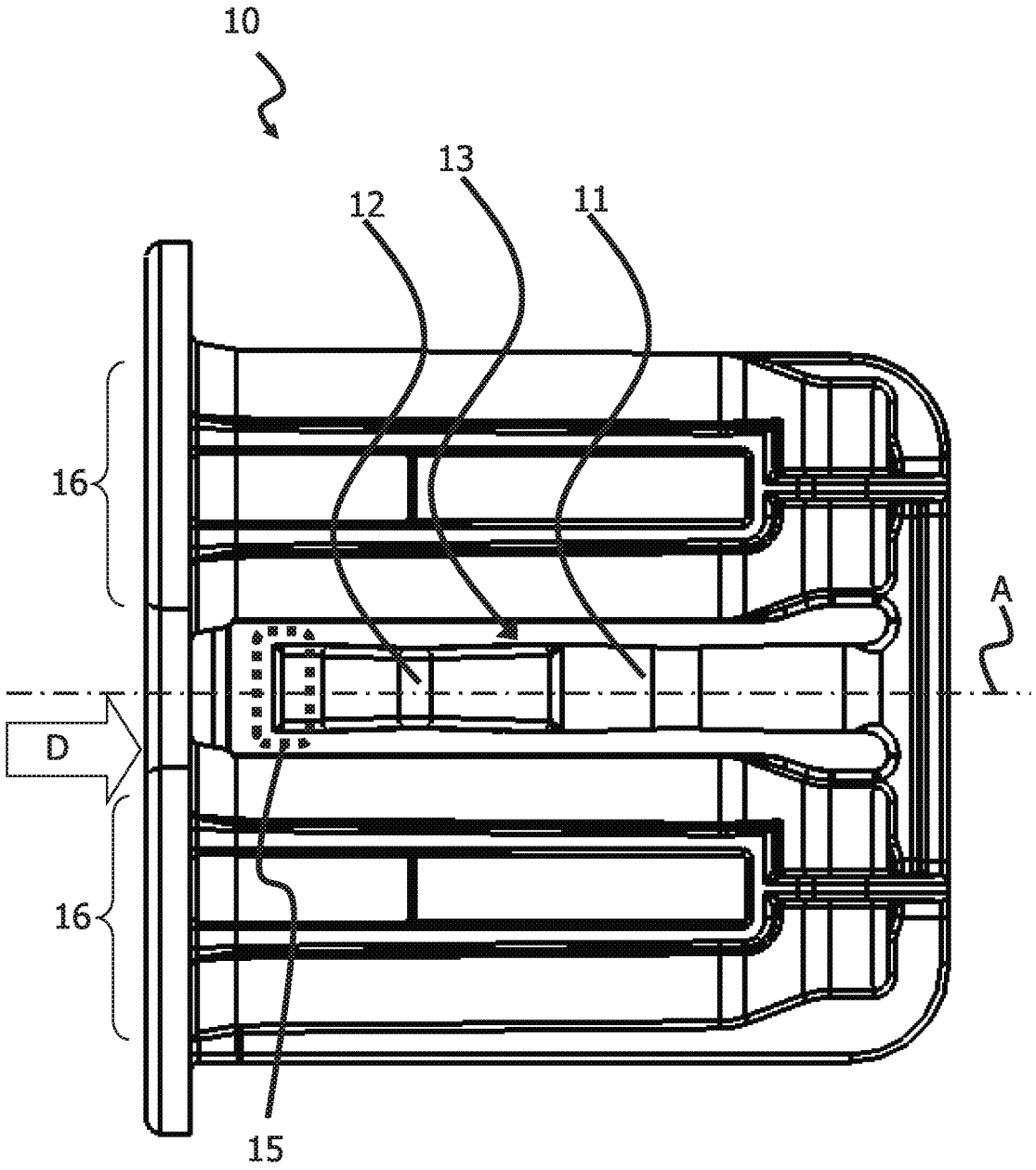
FIG. 3 is a plan view of the part depicted in FIG. 2.

The exemplary part 10 given in the drawings includes two engagement sites, yet the invention is also directed to the same with a higher number of engagement sites. FIG. 2 shows a perspective view and FIG. 3 shows a plan view of the part 10 as described herein.

The first engagement site 11 and the second engagement site 12 are distributed around an axis A along a direction D which is to be followed at a process for releasably securing of the part 10.

Figure 8:
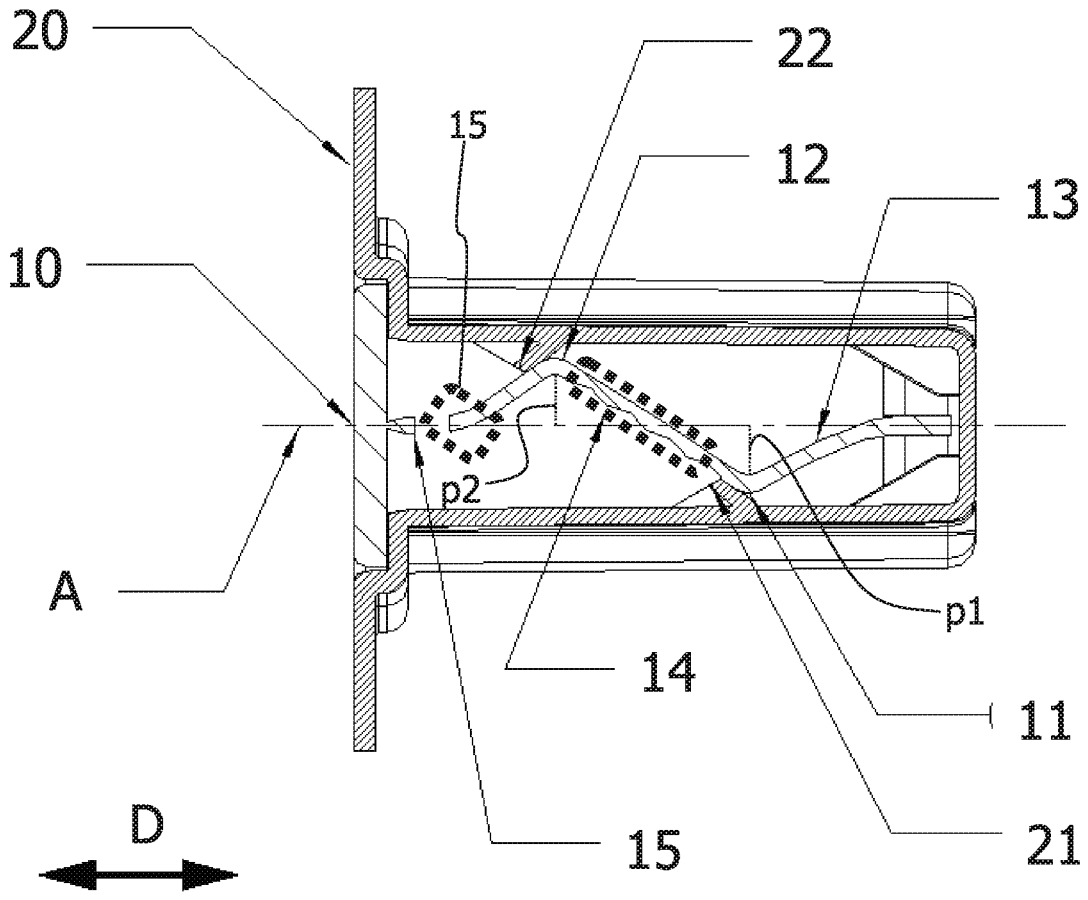
FIG. 8 is a sectional view taken along the line VIII-VIII depicted in FIG. 7, for clearly showing an exemplary releasable snap-fit connection between the plurality of engagement sites (depicted as a first and a second engagement site) with respective counterparts.

In the household appliance 100 according to the present invention, each of the first engagement site 11 and second engagement site 12 has a different respective orthogonal projection shown as p1 and p2 in FIG. 8, respectively on the axis A.

This feature provides an easy and balanced snap-fit connection by distribution of pressure on the part 10 along the axis A at releasable attachment of the part 10.

In a possible embodiment according to the present invention, the part 10 can include a male snap-fit connector 13 which is provided with the first engagement site 11 and second engagement site 12. An exemplary embodiment of the part 10 where the first engagement site 11 and the second engagement site 12 being provided on a male snap-fit connector 13, is depicted in the figures, in particular in FIG. 2, FIG. 3, FIG. 8 and FIG. 11.

Figure 4:
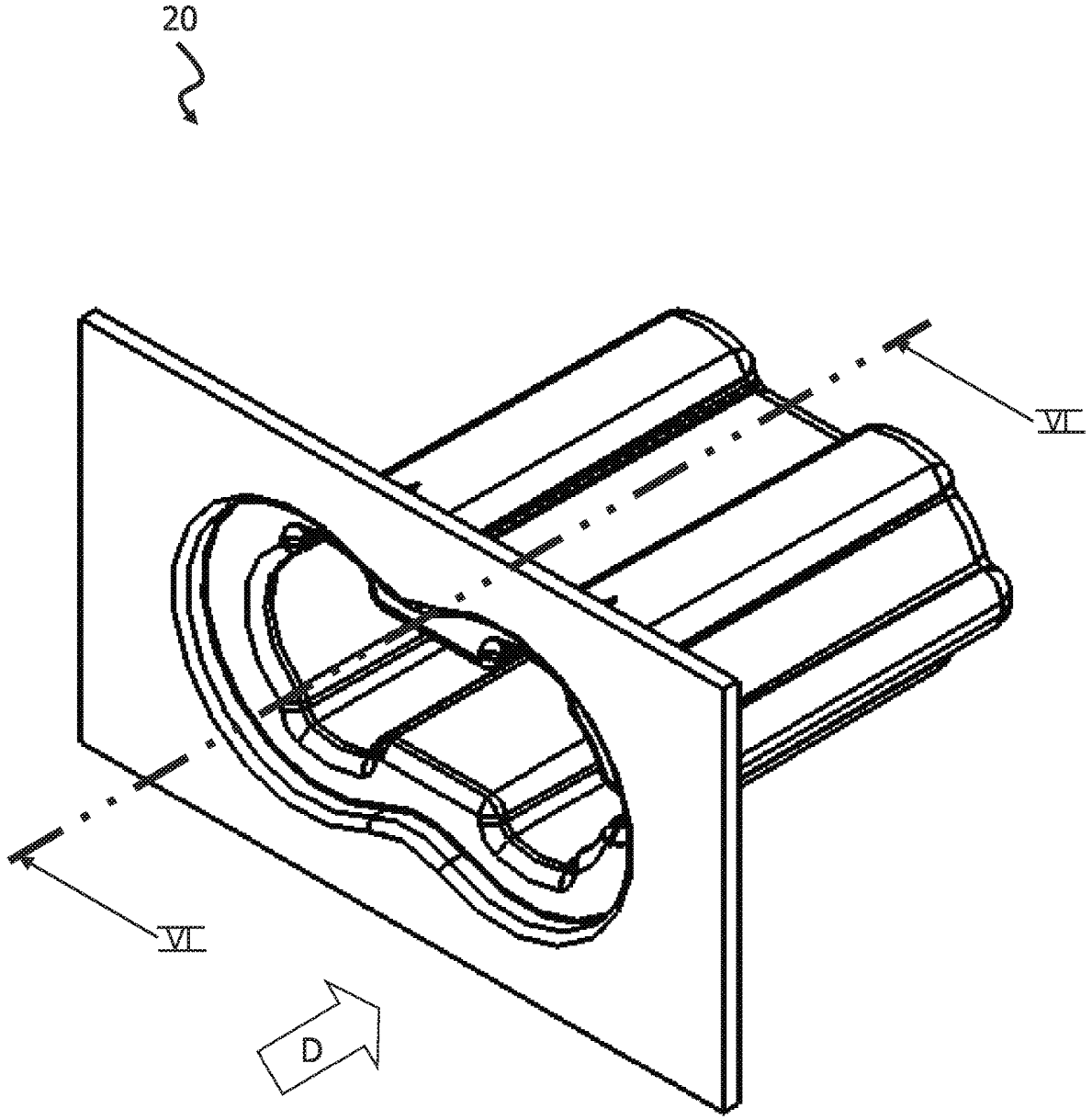
FIG. 4 is a perspective view of an exemplary housing for being coupled with the part to be employed in the household appliance according to the present invention.
Figure 5:
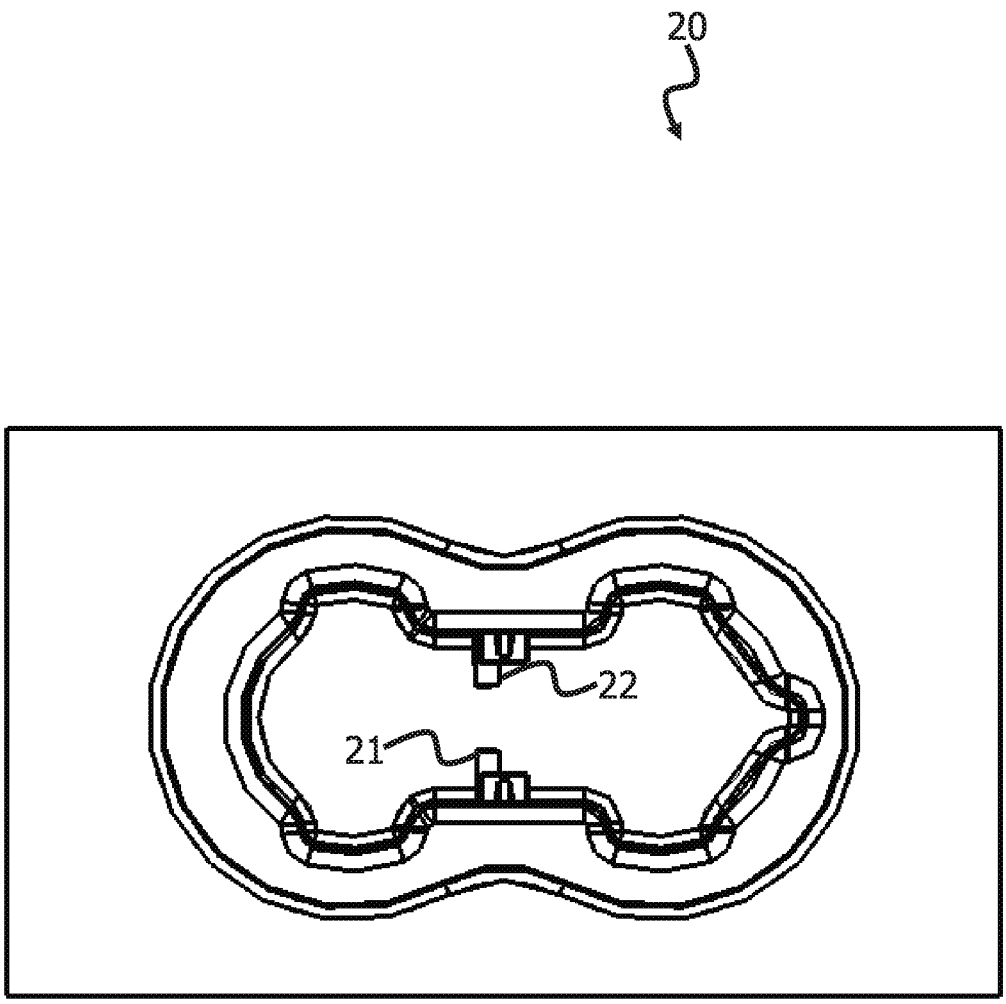
FIG. 5 is a front view of the housing depicted in FIG. 4.
Figure 6:
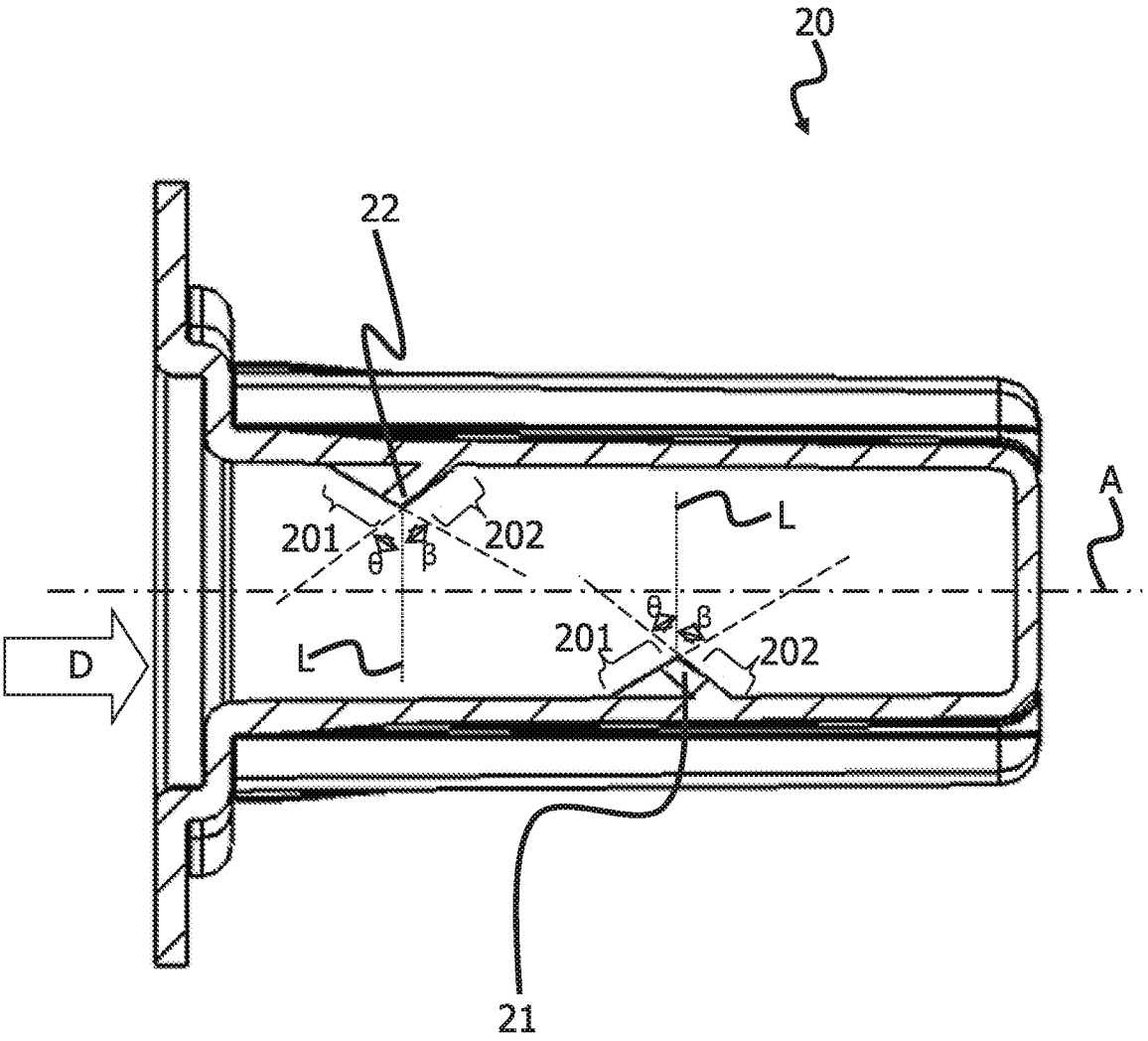
FIG. 6 is a sectional view of the housing taken along the line VI-VI depicted in FIG. 4, for clearly showing the counterparts which are exemplified as being provided on the housing.
Figure 7:
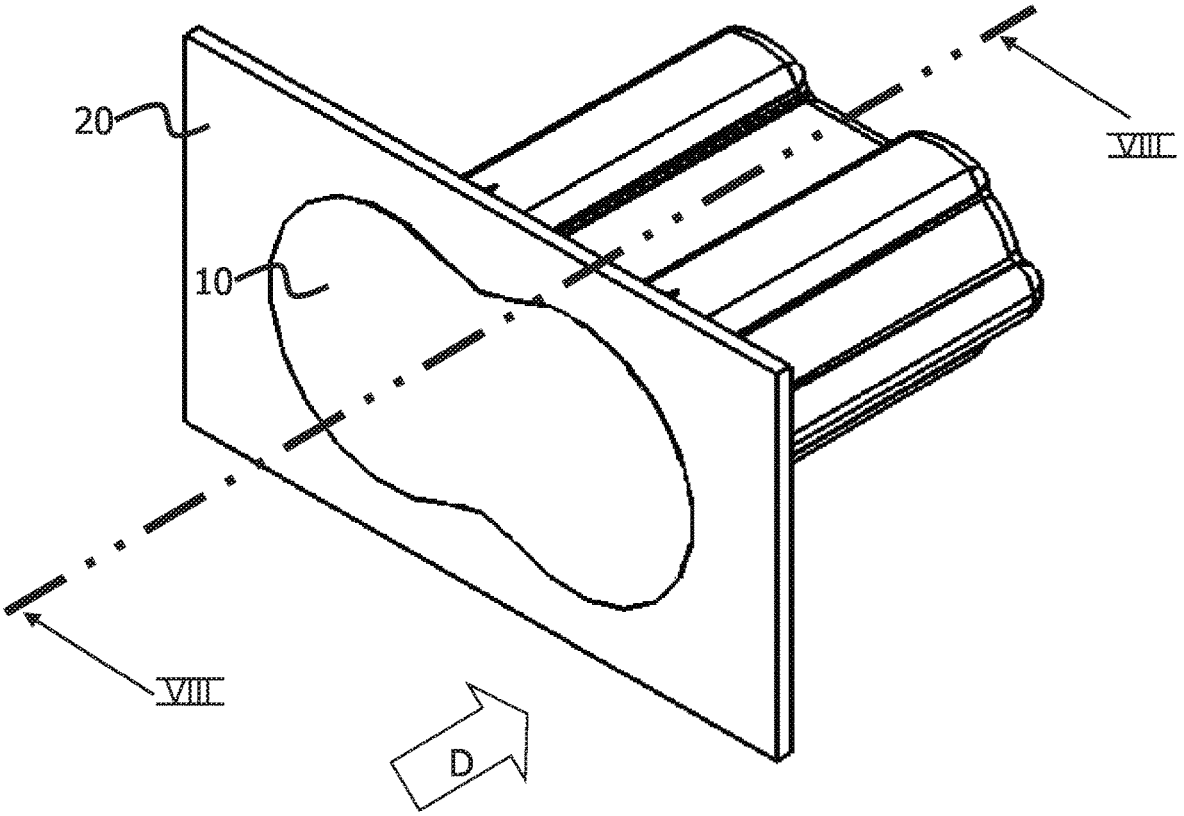
FIG. 7 is a perspective view of a coupled item including the part, engagement sites of which being coupled with respective counterparts, the parts being exemplified as being provided on inner portions of a housing, and thereby the releasable snap-fit connection between the engagement sites and the counterparts being hidden inside the housing.

The male snap-fit connector 13 can be adapted to engage with a female snap-fit connector 20 which is provided with a respective plurality of counterparts including a first counterpart 21 a second counterpart 22, which are adapted by their shape and size to respectively engage or threshold the first engagement site 11 and the second engagement site 12 at the releasably securing. An exemplary female snap-fit connector 20 according to the present description is depicted in FIG. 4, FIG. 5 and FIG. 6; and its assembly with the part 10 is depicted in FIG. 7 to FIG. 11.

The male snap-fit connector 13 can be attached to the part 10 at a first end thereof, such that another end of the male snap-fit connector 14 distal to the first end remains as a free-end 15. This feature provides an enhanced flexibility to the male snap-fit connector 13, enabling the reversible attachment to be achieved with minimized extent of forces exerted onto the first engagement site 11 and onto the second engagement site 12; and thereby prolonging the service life of the part 10.

Figure 11:
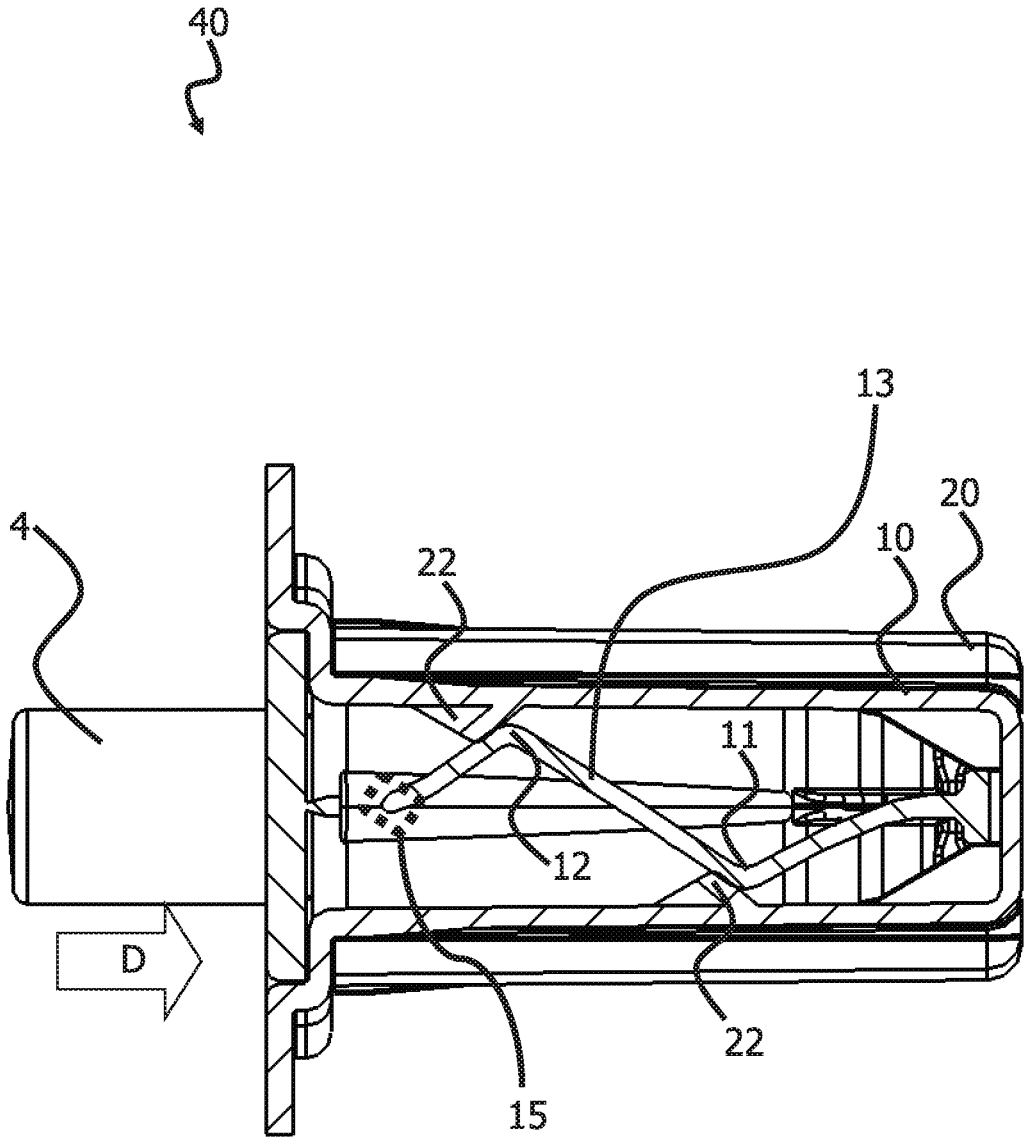
FIG. 11 is a sectional view of the item taken along the line XI-XI depicted in FIG. 9, for clearly exemplifying a case where the plurality of engagement sites (depicted as a first and a second engagement site) and respective counterparts remain between adjacent damping units.

The male snap-fit connector 13 described above can be embodied e.g. in the shape of a so-called zigzag as depicted in FIG. 2, FIG. 8 and FIG. 11. The zigzag shape is an exemplary way for providing that the orthogonal projections p1 and p2 are radially distributed on the axis A, with the use of a minimum amount of material in formation of the male snap-fit connector 13.

A portion 14 of the male snap-fit connector 12 between the first engagement site 11 and the second engagement site 12 can be undulated. The above mentioned zigzag shape inherently includes undulations, thereby the zigzag shape can be considered as an example to such embodiment. The undulations provide an enhanced flexibility to the male snap-fit connector 12, thereby facilitates the releasable attachment of the part 10 with minimized axial and radial forces exerted onto the male snap-fit connector 12 at its first engagement site 11 and second engagement site 12.

In a possible embodiment according to the present invention, one or more of the first counterpart 21 and second counterpart 22 can have:

a) a first side surface 201 adapted (e.g. by its shape and size), to be pushed by a respective engagement site at a securing phase of a releasably securing process of the part 10, and b) a second side surface 202 adapted (e.g. by its shape and size), to be pushed by the respective engagement site at a releasing phase of the releasably securing process;

c) such that a first angle β between the first side surface 201 and a line L orthogonal to the axis A is wider than a second angle θ between the second side surface (202 and the line L.

Such difference between the first angle β and the second angle θ provides a facilitated attachment of the part 10 in comparison with the detachment thereof. This embodiment is exemplified in FIG. 6, in which such comparison between the first angle β and the second angle θ is emphasized at both of the first counterpart 21 and the second counterpart 22.

In a possible embodiment, the female snap-fit connector 20 can be adapted to at least partly receive the part 10. Such a receipt of the part 10 by the female snap-fit connector 20 is depicted for the exemplary embodiments, in FIG. 7, FIG. 8 and FIGS. 9-11.

Figure 9:
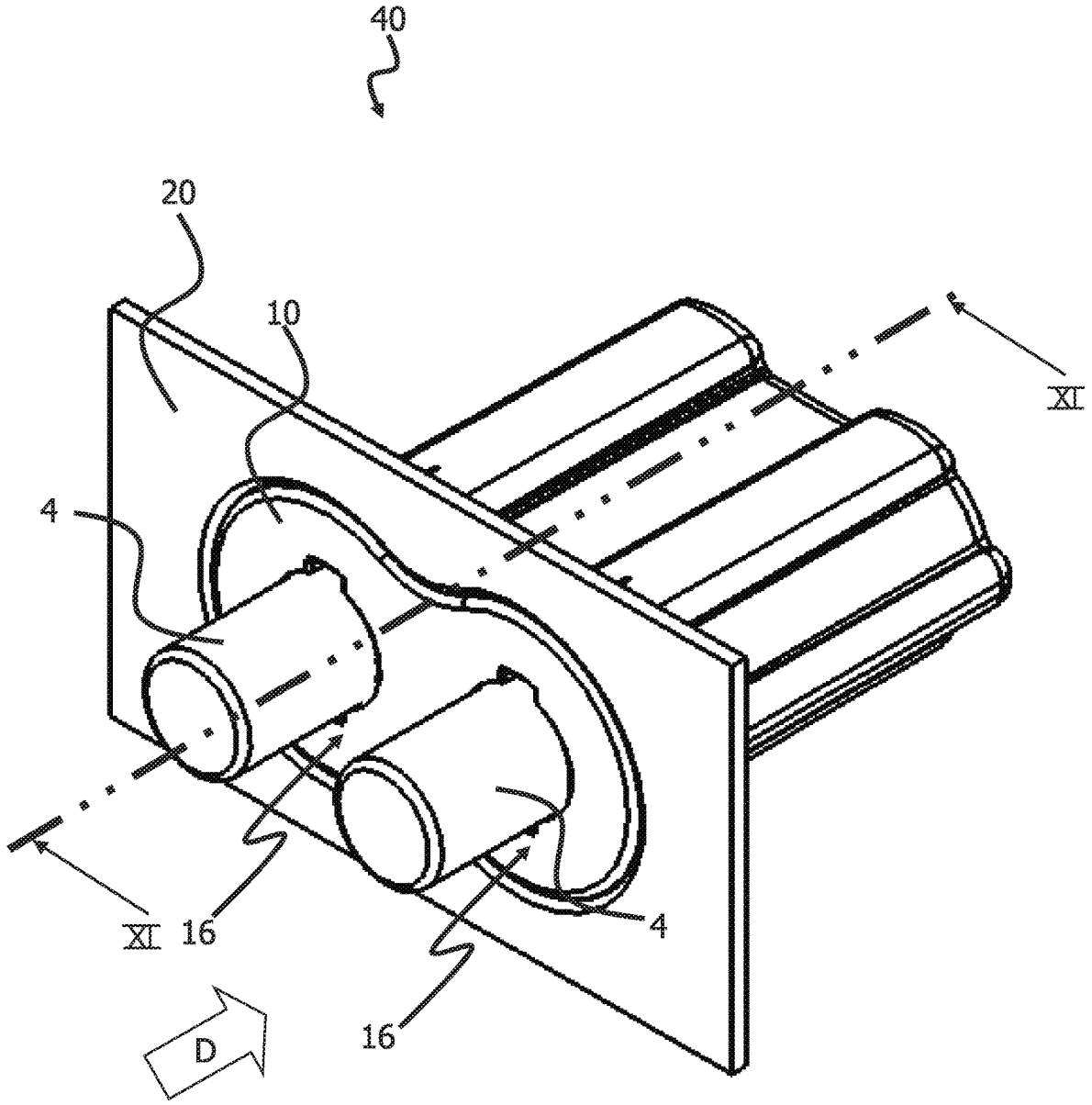
FIG. 9 is a perspective view of an exemplary damper assembly to be employed in the household appliance according to the present invention.
Figure 10:
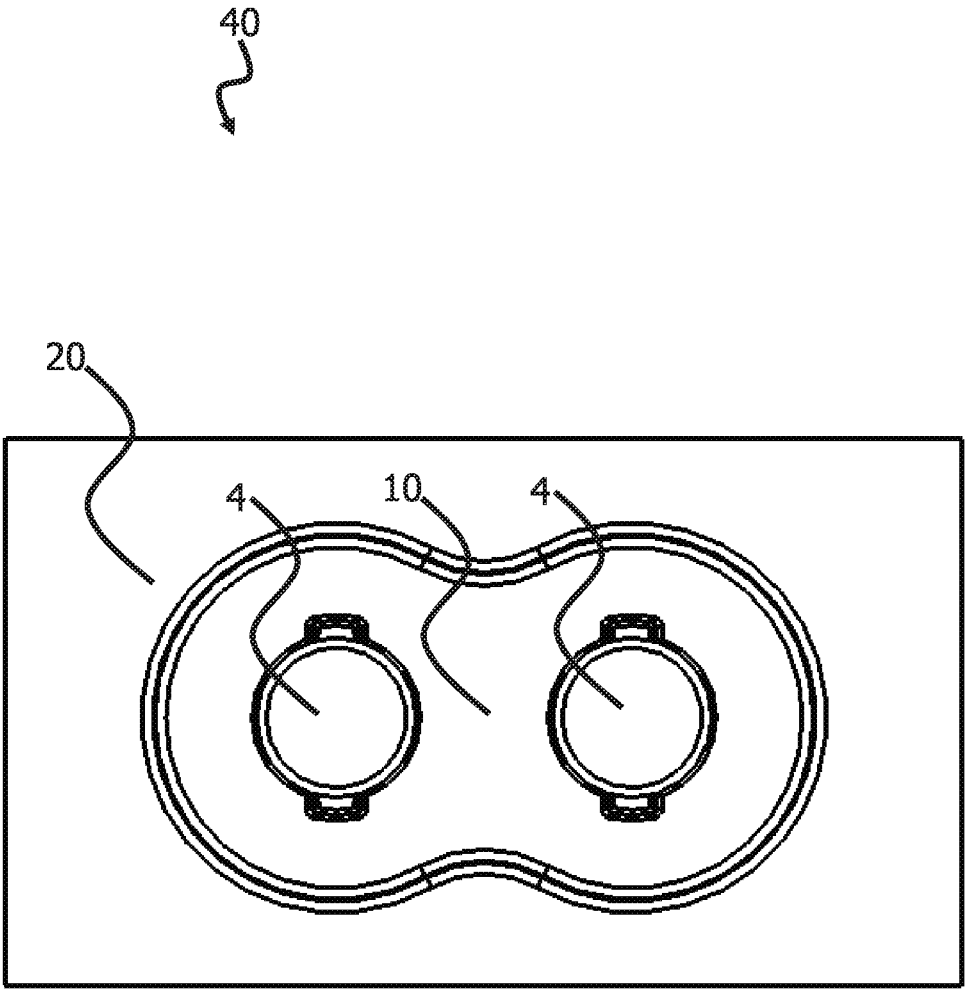
FIG. 10 is a front view of the damper assembly shown in the FIG. 9.

The part 10 can further include one or more housings 16 for at least partly receiving and guiding one or more respective damping units 4, and thus partly forming the damper assembly 40. FIG. 9, FIG. 10 and FIG. 11 exemplify such embodiment, wherein the part 10 includes a couple of housings 16 provided with a respective couple of damping units 4 to form a damper assembly 40 with two damping units 4. With the features described above, the direction D which is to be followed at a process for releasably securing of the part 10 can be substantially parallel to a damping direction of the damper assembly 40; which enables a facilitated single-direction assembly, which can include the following steps:

a) placing the female snap-fit connector 20 at a zone on the household appliance 100 dedicated thereto, by pushing the female snap-fit connector 20 in a direction D;

b) placing the part 10 mainly into the female snap-fit connector 20, by pushing the part 10 in the direction D; and c) placing the damping unit(s) 4 partly into respective housing(s) provided on the part 10; by pushing the damping unit(s) 4 in the direction D.

Thus the present invention proposes a facilitated assembly of a household appliance 100, each step thereof being performable by motions mainly in the same direction D.

The part 10 can include a plurality of housings 16 for at least partly receiving and guiding a plurality of respective damping units 4; and the axis A can be located between two adjacent housings 16. In FIG. 11 showing a XI-XI sectional view of the item (damping unit, 40) depicted in FIG. 9, exemplifies a case where the plurality of engagement sites (first engagement site, 11 and second engagement site, 12) and respective counterparts (first counterpart, 21 and second counterpart, 22) remain between adjacent damping units 4.

In a possible embodiment according to the present invention, the damper assembly 40 can be adapted to dampen a door 101 of the household appliance 100 at closing of the door 101. The household appliance 100 shown in FIG. 1 is exemplified to have a couple of doors 101 and respective damper assemblies 40 for provision of soft closing of the couple of doors 101. As seen in the exemplary embodiment shown in FIG. 1, the household appliance 100 according to the present invention can be a cooling appliance, e.g. a refrigerator.

All features and details explained above may be combined in any technically enabling combination.

The household appliance according to the present invention provides a balanced and reliable snap-fit connection with prolonged service life. The snap-fit connection used in such household appliance 100 is easy to assemble and disassemble. Furthermore, in the above described embodiment provided with the damper assembly 40, the household appliance 100 has a soft door closing mechanism which is easy to assemble and disassemble. Thus, the above mentioned problems are solved, with the household appliance 100 according to the present invention.

The following is a list of reference numerals appearing in the drawing figures and in the above description:

10 part
11 first engagement site
12 second engagement site
13 male snap-fit connector
14 portion
15 free end
16 housing
20 female snap-fit connector
21 first counterpart
22 second counterpart
4 damping unit
40 damper assembly
100 household appliance
101 door
201 first side surface
202 second side surface
A axis
β first angle
D direction
L line orthogonal to the axis
p1 orthogonal projection of the first engagement site on the axis
p2 orthogonal projection of the second engagement site on the axis
θ second angle

The invention claimed is:

1. A household appliance, comprising:

a part being releasably attached onto the household appliance through a snap-fit connection, said part including a male snap-fit connector having a longitudinal zigzag extent, said male snap-fit connector having at least two engagement sites including a first engagement site and a second engagement site distributed around an axis of said part along a release direction to be followed at a process for releasably securing of said part, each of said first engagement site and said second engagement site being provided along a longitudinal length of said male snap-fit connector for having a different respective orthogonal projection on the axis.

2. The household appliance according to the claim 1, wherein said different respective orthogonal projections are radially distributed on the axis.

3. The household appliance according to claim 1, further comprising a female snap-fit connector having respective counterparts including a first counterpart and a second counterpart; and wherein said male snap-fit connector is adapted to engage with said female snap-fit connector where said first counterpart and said second counterpart respectively engage said first engagement site and said second engagement site for forming the releasably securing.

4. The household appliance according to claim 3, wherein said male snap-fit connector is attached to said part at a first end of said male snap-fit connector thereof, such that another end of said male snap-fit connector distal to said first end remains as a free-end.

5. The household appliance according to claim 3, wherein at least one of said first counterpart and said second counterpart has:

a first side surface adapted to be pushed by one of said engagement sites during a securing phase of a releasably securing process of said part; and a second side surface adapted to be pushed by one of said engagement sites at a releasing phase of the releasably securing process such that a first angle between said first side surface and a line orthogonal to the axis is wider than a second angle between the second side surface and the line.

6. The household appliance according to claim 3, wherein said female snap-fit connector is adapted to at least partly receive said part.

7. The household appliance according to claim 1, further comprising at least one damping unit; and said part having at least one housing for at least partly receiving and guiding said at least one damping unit, and thus partly forming a damper assembly, the release direction being substantially parallel to a damping direction of the damping assembly.

8. The household appliance according to claim 7, wherein:

said damping unit is one of a plurality of damping units; and said housing is one of a plurality of housings for at least partly receiving and guiding respective ones of said plurality of damping units, and said axis is located between two adjacent ones of said housings.

9. The household appliance according to claim 7, further comprising a door;

wherein said damper assembly is adapted to dampen said door of the household appliance at a closing of said door.

10. The household appliance according to claim 1, wherein the household appliance is a cooling appliance.

11. The household appliance according to claim 10, wherein the household appliance is a refrigerator.

12. A household appliance, comprising:

a part being releasably attached onto the household appliance through a snap-fit connection, said part including a male snap-fit having at least two engagement sites including a first engagement site and a second engagement site distributed around an axis of said part along a release direction to be followed at a process for releasably securing of said part, each of said first engagement site and said second engagement site being provided along a longitudinal length of said male snap-fit connector and having a different respective orthogonal projection on the axis, a portion of said male snap-fit connector between said first engagement site and said second engagement site having undulations.

* * * * *